United States Patent [19]

Kawawa et al.

[11] 4,027,844

[45] June 7, 1977

[54] BIG-END-DOWN INGOT MOLD FOR CASTING METAL

[75] Inventors: Takaho Kawawa; Masaharu Ito, both of Fukuyama, Japan

[73] Assignee: Nippon Kokan Kabushiki Kaisha, Tokyo, Japan

[22] Filed: June 14, 1976

[21] Appl. No.: 695,458

[30] Foreign Application Priority Data

June 18, 1975 Japan ..... 50-74053

[52] U.S. Cl. ..... 249/111; 249/174

[51] Int. Cl.[2] ..... B22D 15/00; B22D 7/06

[58] Field of Search ..... 249/174, 204, 105, 106, 249/108, 111, 113, DIG. 5; 164/273 R

[56] References Cited

UNITED STATES PATENTS

| | | | |
|---|---|---|---|
| 669,952 | 3/1901 | Brinton | 249/111 |
| 1,204,270 | 11/1916 | Greene | 249/106 |
| 1,634,999 | 7/1927 | Krause | 249/111 |
| 3,612,158 | 10/1971 | Rossi | 249/135 X |

*Primary Examiner*—Francis S. Husar
*Assistant Examiner*—John S. Brown
*Attorney, Agent, or Firm*—Flynn & Frishauf

[57] ABSTRACT

A big-end-down ingot mold has a heat insulating chamber which, when the ratio of the width of the wider walls to that of the narrower walls of the mold is less than 1.7:1, is formed in each of the four side walls and, when the ratio is 1.7:1 or more, is formed in each of the two opposed wider walls and whose horizontal sectional areas each gradually increase from below toward above. By means of the heat insulating chambers the solidification rate of the molten metal is regulated to prevent the formation of secondary pipes and segregation around the pipes within an ingot cast in the mold.

9 Claims, 9 Drawing Figures

FIG. 1
PRIOR ART
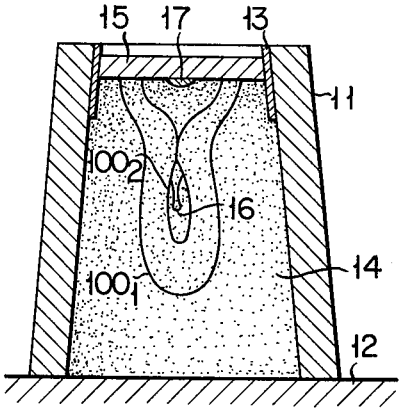
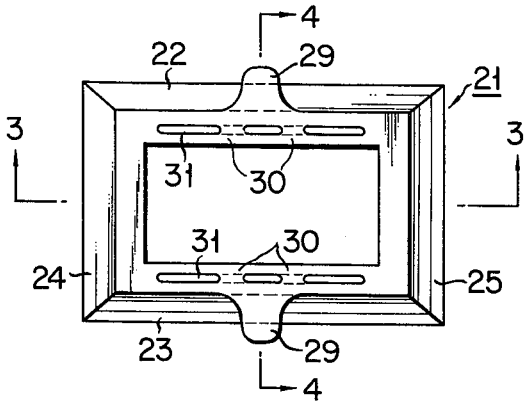
FIG. 2
FIG. 3
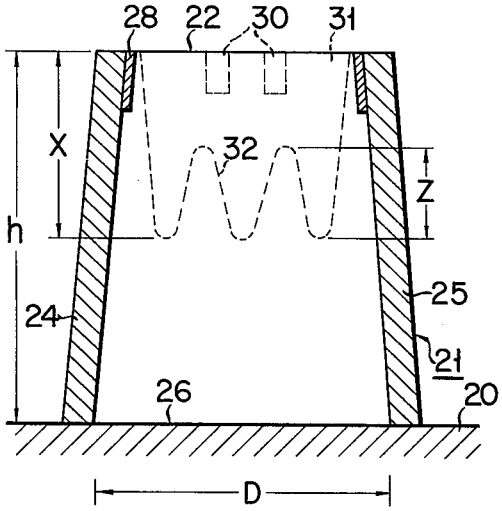

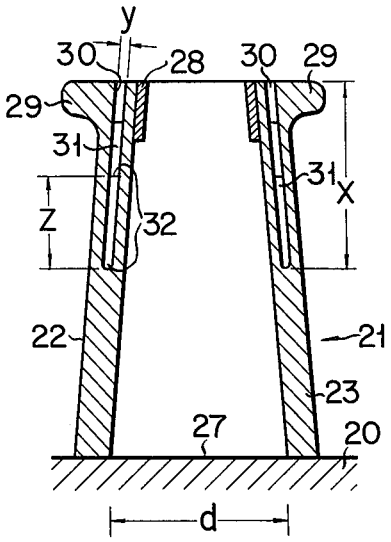
FIG. 4
FIG. 5
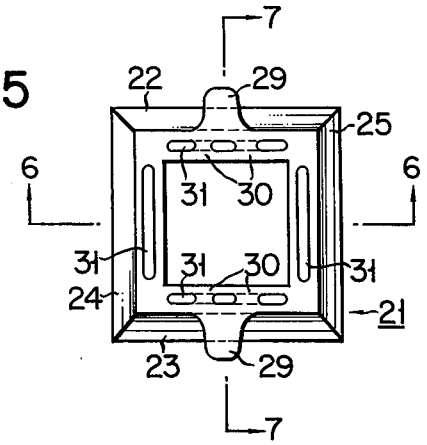
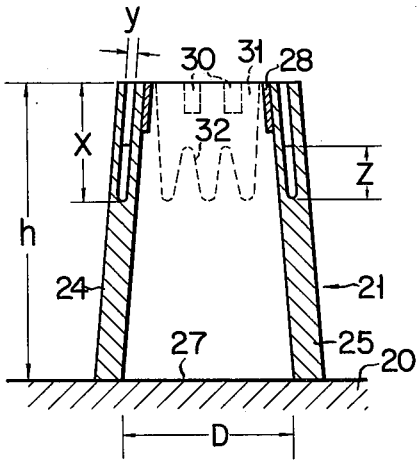
FIG. 6

BIG-END-DOWN INGOT MOLD FOR CASTING METAL

FIELD OF THE INVENTION

This invention relates to a big-end-down ingot mold for casting metal, and more particularly to an improved big-end-down ingot mold adapted to prevent the formation of secondary pipes and segregations around the pipes within a cast ingot by controlling the solidification rate of a molten metal.

DESCRIPTION OF THE PRIOR ART

Generally, in an ingot cast in a mold, shrinkage pipes are formed in a central part of the top and in the neighbourhood of the shrinkage pipes and segregation of impurities are produce, thereby to decrease the mechanical strength of the ingot. Particularly, a slab which is obtained from a steel ingot by rolling process becomes defective when, even if not seen from the appearance, shringkage pipes and/or segregation around the pipes is found in the slab or products made therefrom, for example, by an ultrasonic inspection.

Steel plates prepared from the slab containing such secondary shrinkage pipes or segregation of impurities are wholly made defective, or, in the case of producing such specially large and thick steel plates as usually two to four plates can be produced from a slab, one or two plates become defective. As a result, defective steel plates sometimes amount to 50 to 100%. Accordingly, it is required that the secondary shrinkage pipes or the like exist within the ingot as few as possible, and for this purpose the methods of increasing the yield of an ingot portion having a normal structure are usually adopted. Conventionally, the following methods are employed:

1. The method comprising the steps of fixedly mounting on the top of a big-end-down ingot mold a hot top consisting of heat insulation boards or bricks, pouring the molten metal up to the interior of the hot top side board to gradually decrease the solidification rate of the molten metal toward the upper part thereof thereby to form secondary shrinkage pipes and/or segregation in the interior of the hot top and cutting off, after solidification, that portion of the resulting ingot which is received in the hot top;

2. The method of lining the upper part of the inner wall of the big-end-down ingot mold to with heat insulation boards or bricks thereby to gradually decrease the solidification rate of the molten metal poured into the mold toward the upper part thereof;

3. The method of putting, in addition to the methods mentioned in the above items (1) and (2), heat insulation material such as straw ash, or exothermic material on the upper face of the molten metal within the mold, or alternatively heating an upper face portion of the molten metal by application of an electric arc thereto, thereby to delay the solidification of the upper face portion of the molten metal; and 4. The method of using a big-end-up mold as the mold, plus a combination of the methods stated in the above items (1) to (3).

The above-enumerated methods (1) to (4) using heat insulation members, heat insulation material, exothermic material and electric arcs, however, have the drawbacks that they can not sufficiently control the decrease in the solidification rate of an upper part of the molten metal, and are unsuitable especially for the casting of high-strength steel. Further, upon stripping an ingot from a big-end-up mold, the ingot must be inverted together with the mold and thereafter must be removed therefrom. This causes not only a decrease in the stripping efficiency but also an increase in the manufacturing cost of the ingot, since additional equipment is required for the stripping operation. Besides, when a steel ingot is cast by the use of the big-end-up mold, a sedimental crystal zone thereof is more broadly distributed at the bottom section of the steel ingot than that of a steel ingot cast by using the big-end-down ingot mold, and therefore within this zone negative segregation is formed disadvantageously to decrease the mechanical strength of an ingot portion corresponding to that zone.

Accordingly, the object of this invention is to provide a big-end-down ingot mold which permits secondary shrinkage pipes or segregation to be produced only at, and at the vicinity of, the top of the resulting ingot, thereby to increase the manufacturing yield of high quality ingots, and from which the ingot can be easily stripped.

SUMMARY OF THE INVENTION

According to the invention, there is provided a big-end-down ingot mold having in its side walls heat insulating chambers whose horizontal sectional areas each gradually increase from below toward above. Since these heat insulating chambers gradually decrease the heat transfer from a molten metal in the mold to the atmosphere through the side wall of the mold toward the upper part of the molten metal, the solidification of the molten metal is gradually delayed toward the upper part thereof to decrease the possibility that secondary shrinkage pipes or segregation around the pipes is produced within the resulting ingot, whereby a good quality ingot is obtained. Where the mold is of a slab configuration, the depth of the heat insulating chamber is chosen to be less than the difference between the height of the mold (more precisely the height of the ingot) and the width of the narrower walls of the mold. Where the ratio of the width of the narrower walls of that of the narrower walls is less than 1.7:1, the heat insulating chamber is formed in all of the four side walls. In contrast, where said ratio is 1.7:1 or more, the heat insulating chamber is formed in the wider walls. By doing so, a suitable amount of heat can be dissipated from the molten metal into the atmosphere through various portions of the side walls of the mold.

BRIEF DESCRIPTION OF THE DRAWINGS

FIG. 1 is a vertical sectional view of an example of a prior art big-end-down ingot mold;

FIG. 2 is a plan view of an example of a big-end-down ingot mold embodying the invention;

FIG. 3 is a sectional view on line 3—3 of FIG. 2;

FIG. 4 is a sectional view on line 4—4 of FIG. 2;

FIG. 5 is a plan view of another example of the big-end-down ingot mold embodying the invention;

FIG. 6 is a sectional view on line 6—6 of FIG. 5;

DETAILED DESCRIPTION

Figure 7:
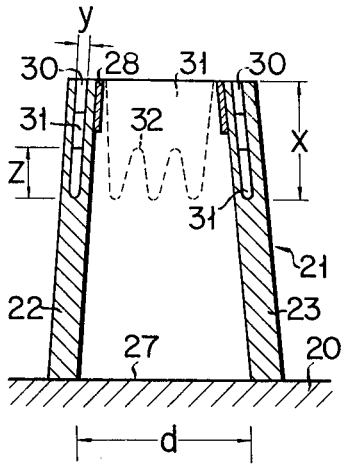
FIG. 7 is a sectional view on line 7—7 of FIG. 5.
Figure 8:
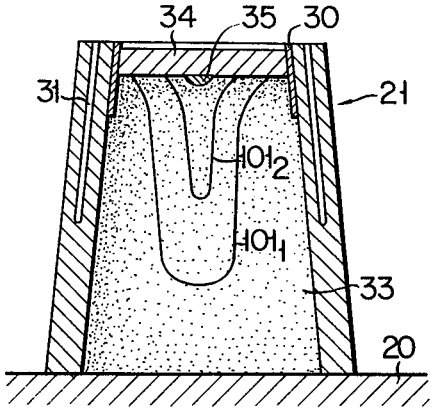
FIG. 8 is a vertical sectional view of the isothermal solidification fronts of a molten metal within the big-end-down ingot mold of the invention.

A big-end-down ingot mold according to this invention is used to cast an ingot of any castable metal including not only iron and steel but also non-ferrous metal such as aluminum, copper. Throughout the Figures, the same parts and sections are denoted by the same reference numerals.

FIG. 1 is a vertical sectional view showing an example of a known big-end-down ingot mold. The big-end-down ingot mold 11 is mounted on an ingot stool 12 and has insulating boards 13 bonded thereto at the upper end portions of its inner wall surfaces. The insulating boards 13 are each formed of heat insulating material such as pulp, asbestos or silica and are constructed such that, after a molten metal is poured into the mold, the surface of the molten metal is covered with an insulating material 15 formed of the same material as that of the insulating board 13.

Although the above known mold 11 is provided with the insulating boards 13 and the insulating material 15. In the solidification rate of an ingot cast by the big-end-down mold 11 does not so vary between at the upper and lower parts of the ingot. In addition, the horizontal sectional area of the casting mold 11 (in other words, the horizontal sectional area of the ingot) becomes larger toward the lower end thereof. This causes isothermal solidification fronts $\mathbf{100_1}$ and $\mathbf{100_2}$ of the ingot to assume a pot-or ℧-shaped configuration whose upper portion is narrowed, and causes the isothermal solidification fronts to assume a closed surface $\mathbf{100_2}$ with the molten metal left therein at the final stage of the solidification. Accordingly, the molten metal in the hot top cannot be fed to the interior of the closed isothermal solidification fronts $\mathbf{100_2}$ with the result that secondary shrinkage pipes 16 are formed in said interior and other chemical components than iron are segregated in the neighborhood of the pipes 16. Furthermore, within an ingot top a segregation zone 17 is formed.

FIGS. 2 to 4 show the big-end-down ingot mold (hereinafter referred to simply as big-end-down mold) according to an embodiment of the invention. The mold 21 is mounted on an ingot stool 20 and has four side walls 22, 23, 24 and 25 and is rectangular in horizontal cross section. The ratio of the inside distance D between the bottoms 26 of the wider walls 22, 23 to the inside distance *d* between the bottoms of the narrower walls 24, 25 is chosen to be 1.7:1 or more. On the inner face of the side walls 22 to 25 are fitted insulating boards 28 similar to the boards 13 of FIG. 1. From central parts of the upper end portions of the outer surfaces of the wider walls 22, 23 are hooks 29 for use in stripping, which is similar to those of a conventional mold. The wider walls 22, 23 are each provided with slot like cavity portions 31 (which are hereinafter referred to as "heat insulating chamber") extending downward from its upper end face to an intermediate portion between this end face and the bottom and opening to the atmosphere at that upper end face, except for portions 30 of that part of each side wall 22, 23 which corresponds to the root of the hook 29. The portions 30 are solid so that, when the mold 21 is lifted at the hooks 29, those portions of the walls 22, 23 from which the hooks 29 are projected may be not broken due to the weight of the ingot and the mold 21. Note here that the upper end face of the heat insulation chambers 31 may not open to the atmosphere and in this case the interior of the chamber 31 may be vacuumized. In any case, the chambers 31 are provided for the purpose of permitting radiation of heat.

A big-end-down mold 21 as shown in FIGS. 5 to 7 is mounted on the ingot stool 20, and is similar to the mold 21 of the embodiment shown in FIGS. 2 to 4, but is different therefrom in that the ratio of the inside distance D between the bottoms 26 of the wider walls 22, 23 to the inside distance d between the bottoms of the narrower walls 24, 25 is chosen to be in the range of 1:1 to 1.7:1; and the heat insulating chamber 31 is provided in any one of the side walls.

Since air exists within the heat insulating chamber 31, usually, therefore, much less heat is transferred through the chamber 31 than through the solid portion of the side walls. Accordingly, the solidification rate at the upper part of the ingot is smaller than that at the lower part thereof and as a result the ingot is gradually solidified from below to above. For heat-insulating an upper part of the molten metal, the heat insulating chamber 31 may be vacuumized, or may be hermetically sealed after being charged with an inert gas, or may be charged with a heat insulation material such as pulp, asbestos, or silica.

In the embodiment shown in FIGS. 2 to 4, the heat insulating chamber 31 is provided only in the wider walls 22, 23 and not in the narrower walls 24, 25. The reason is that where the ratio of D to *d* is 1.7:1 or more, most heat transfer from the upper part of the walls 22, 23 and the solidification rate in the central portion of the ingot is chiefly controlled by the heat transfer through the wider walls 22. Thus, it is enough to form the heat insulating chambers 31 only in the wider walls 22, 23. In contrast, where, as in the embodiment shown in FIGS. 5 to 7, the ratio of D to *d* ranges between 1:1 and 1.7:1, the heat transfer through the narrower walls 24, 25 cannot be neglected and, therefore, the heat insulating chamber 31 must be provided in every side wall. Further, in the case of a frustoconical big-end-down mold, for the same reason as in the embodiment of FIGS. 5 to 7, the heat insulating chamber has to be provided in the whole upper portion of the side wall. The critical value 1.7:1 of the ratio of D to *d* is obtained from experiments made by the present inventor.

As shown in FIGS. 3, 4, 6 and 7, the bottom section 32 of the heat insulating chamber 31 is made wavy. When the chamber 31 assumes such a wavy configuration, the heat transfer decreases gradually toward the uppermost end of the chamber 31 since the horizontal sectional area thereof gradually increases toward said uppermost end. This means that the solidification time is gradually delayed toward the uppermost portion of the molten metal; and the solidification rate becomes lower from the periphery of the molten metal toward the center thereof.

Since the heat of the lower part of the molten metal within the mold 21 is dissipated not only from the side walls 22 to 25 but from the ingot stool 20, the solidification continuously occurs from below to above and from the periphery to the center. According to the present inventor's experiments it has been found that there is no need to provide a heat insulating chamber in the side wall over a zone extending from the ingot stool 20 to a nearly intermediate portion of the molten metal; and when it is now assumed that h represents the height of the mold 21 (strictly, the height of the ingot or molten metal), the maximum depth *x* of the chamber 31 has only to be defined as:

$x \leqq h - d.$

Further, the difference z between the lowest level and the highest level of the wavy bottom section 32 of the chamber 31, though it varies due to a heat insulating condition at the top portion of the molten metal and the configuration of the mold, is maximum when the level of the highest portion of the bottom section 32 is situated at the lower end of the insulating board 28. The reason is that if the highest position of the bottom section 32 is higher than the lower end or edge of the insulating board 28, a heat insulation effect cannot be attained by the combination of the heat insulating chamber 31 and the insulating board 28 but only by the boards 28.

The thickness *y* of the heat insulating chamber 31 is made as large as possible so long as the mechanical strength of the side wall permits. Where this thickness *y* is large, the ammount of heat transferred through the chamber 31 is decreased to permit the heat insulation of the upper part of the molten metal to a greater extent.

By providing, as above described, the heat insulating chamber 31 in the side wall of the mold 21 by selectively determining the maximum depth *x*, the level difference z of the wavy bottom section, the thickness *y*, and the number of waves (usually, 1 to 5 waves) in accordance with the configuration and size of the mold 21, the type of the ingot, etc., the vertical section of the isothermal solidification fronts $\mathbf{101}_1$ and $\mathbf{101}_2$ of the molten metal 33 is allowed to take an upwardly opened U-shape. Thus, neither secondary pipes nor segregation is produced in the central part of the ingot. Only at an area right below a heat insulation material 34, i.e., only at a top portion of the ingot, shrinkage pipes and/or segregation 35 is formed. The taper of the side wall of the mold is chosen to have a minimum value (for example, 1 to 4%) required for stripping the mold.

Using the present big-end-down mold having the dimensions as listed in the table 1, a steel ingot containing 0.13 weight percent of carbon, 0.25 weight percent of silicon, 1.2 weight percent of manganese, 0.013 weight percent of phosphorus, 0.015 weight percent of sulphur and 0.022 weight percent of soluble aluminum was cast and was compared with that having the same proportion of chemical elements, as cast by using a prior art big-end-down mold.

Table 1

| | | Height (h) (mm) | Length of the upside of the Side Wall (mm) | Length of the bottom of the Side Wall (mm) | Thickness of the Side Wall (mm) | x (mm) | y (mm) | z (mm) |
|---|---|---|---|---|---|---|---|---|
| I | 5 ton-steel ingot mold | 1900 | 700 × 491 | 865 × 528 | 130 (average) | 1000 | 50 | 370 |
| II | 30 ton-steel ingot mold | 2750 | 2060 × 780 | 2110 × 865 | 235 (average) | 1650 | 50 | 850 |
| III | 6 ton-square steel ingot mold | 2300 | 625 square | 680 square | 145 (average) | 1600 | 50 | 900 |

(Note: In case of I and II, the heat insulating chamber was provided in the wider wall, and in case of III was provided in all side walls.)

The result is as follows: In the case of the prior art mold, secondary shrinkage pipes are produced at a position spaced 60% from the bottom face of the ingot, and where this ingot was rolled to plates each having a thickness of 25 mm to 200 mm, the defective steel plates found by the ultrasonic inspection reached 10 to 40%. When the mold of this invention was used, the defective steel plates were reduced to 0.5%, and simultaneously the V-shaped segregation was less produced.

Figure 9:
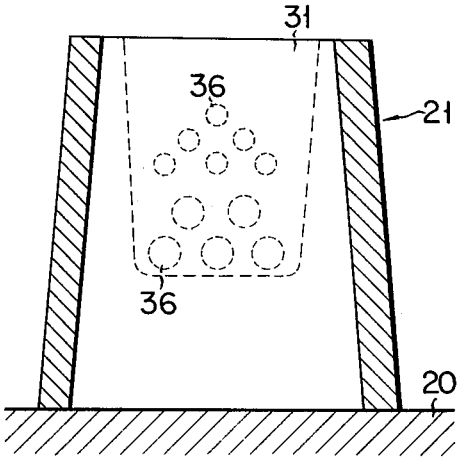
FIG. 9 is a further example of the big-end-down ingot mold of the invention having a modified heat insulation chamber.

FIG. 9 shows the big-end-down mold 21 provided in the side walls with a flat-bottomed slot like heat insulating chamber 31 in place of the heat insulating chamber having the wavy bottom sections as shown in the embodiments of FIGS. 2 to 7. Within the chamber 31 members 36 for regulating the horizontal sectional area of the chamber such as cylindrical iron rods or iron bolts are disposed so as to be more sparsely distributed from below toward above. These members 36 are disposed within the chamber 31 by being inserted into bores formed in the outer faces of the side walls of the mold 21 and, after insertion, are welded to the side walls. Since this chamber 31 also has the horizontal sectional area gradually increased toward above, it will be understood that this chamber 31 performs the same function as in the case of the chamber 31 of the embodiments shown in FIGS. 2 to 7. Further, since the side wall of the mold is firmly supported by the members 36, the chamber 31 has also the function to prevent the deformation of the inner wall portion of the mold exposed to a high temperature.

The above-mentioned big-end-down mold of the invention has the following advantages.

1. In spite of the present mold being of a big-end-down type, secondary shrinkage pipes or segregation around them is little produced in the central part of the ingot and only at a small portion of the ingot top shrinkage pipes or the like are produced, so that the defective ingots are of substantially the same order as that possible with a mold of big-end-up type. Namely, the use of the present big-end-down mold provides a remarkably high yield in production of the ingots as compared with the prior art big-end-down mold.

2. Since the present mold is of a big-end-down type, the negative segregation zone inside the lower part of the ingot is restricted and further the amount of non-metallic substances existing in this zone is decreased.

3. Since the use of the present mold increases the efficiency of the stripping operation as well as the manufacturing yield, the manufacturing cost of the ingots can be reduced.

We claim:

1. A big-end-down ingot mold for casting metal having a side wall, and further comprising a heat insulating chamber in said side wall, the cross-sectional area of said chamber gradually increasing toward the top of the ingot mold, the depth of said chamber being smaller than a difference between the height of the interior of the mold and the bottom length of the inside of a narrower wall of the mold where the interior of the mold has a rectangular cross section and being smaller than the difference between the height of the interior of the mold and the bottom length of the inside of a wall of the mold where the interior of the mold has a square cross section.

2. A big-end-down ingot mold according to claim 1, wherein said chamber has a wavy bottom section.

3. A big-end-down ingot mold according to claim 2, wherein, where the interior of the mold has a rectangular cross section and the ratio of the width of the wider walls of the mold to that of the narrower walls of the mold is 1.7:1 or more, said chamber is formed in the wider walls of the mold.

4. A big-end-down ingot mold according to claim 2, wherein, where the interior of the mold has a rectangular cross section and the ratio of the width of the wider walls of the mold to that of the narrower walls of the mold is in the range of 1:1 to 1.7:1, said chamber is formed in every wall of the mold.

5. A big-end-down ingot mold according to claim 1, wherein said chamber has a flat bottom and includes cross sectional area regulating means which gradually increases the cross-sectional area of said chamber toward the top thereof.

6. A big-end-down ingot mold according to claim 5, wherein said cross-sectional area regulating means comprises a plurality of metallic cylindrical rods disposed more sparsely toward the top of said chamber than toward the bottom of said chamber.

7. A big-end-down ingot mold according to claim 6, wherein each of said metallic cylindrical rods comprises a bolt made of iron.

8. A big-end-down ingot mold according to claim 5, wherein, where the interior of said mold has a rectangular cross section and the ratio of the width of the wider walls of the mold to that of the narrower walls of the mold is 1.7:1 or more, said chamber is formed in the wider walls of the mold.

9. A big-end-down ingot mold according to claim 5, wherein, where the interior of said mold has a rectangular cross section and the ratio of the width of the wider walls of the mold to that of the narrower walls of the mold is in the range of 1:1 to 1.7:1, said chamber is formed in every wall of the mold.

* * * * *